US010932565B2

(12) United States Patent
Bockos

(10) Patent No.: US 10,932,565 B2
(45) Date of Patent: Mar. 2, 2021

(54) APPLIANCE PEDESTAL SYSTEM

(71) Applicant: Electrolux Appliances Aktiebolag, Stockholm (SE)

(72) Inventor: Giancarlo Bockos, Charlotte, NC (US)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 16/519,866

(22) Filed: Jul. 23, 2019

(65) Prior Publication Data

US 2021/0022494 A1 Jan. 28, 2021

(51) Int. Cl.

| | |
|---|---|
| ***A47B 81/00*** | (2006.01) |
| ***D06F 29/00*** | (2006.01) |
| ***A47B 88/487*** | (2017.01) |
| ***A47B 83/00*** | (2006.01) |
| ***D06F 35/00*** | (2006.01) |

(52) U.S. Cl.

CPC ..... *A47B 81/00* (2013.01); *A47B 83/00* (2013.01); *A47B 88/487* (2017.01); *D06F 29/00* (2013.01); *D06F 35/00* (2013.01)

(58) Field of Classification Search

CPC ..... A47B 81/00; A47B 83/00; A47B 88/487; D06F 29/00; D06F 35/00

USPC ..... 312/237, 330.1, 351.1, 351.2

See application file for complete search history.

(56) References Cited

U.S. PATENT DOCUMENTS 1,222,451 A * 4/1917 Ohnstrand ..... A47B 88/956 312/348.4
6,585,225 B1 * 7/2003 Lake ..... A47B 47/0075 206/320
2002/0024275 A1 * 2/2002 Morgan ..... A47B 67/04 312/294
2004/0245899 A1 * 12/2004 Cho ..... A47B 91/005 312/351.2
2005/0172678 A1 * 8/2005 Kim ..... A47B 91/005 68/3 R
2005/0275325 A1 * 12/2005 Yang ..... D06F 39/12 312/330.1
2008/0129173 A1 * 6/2008 Freeberg ..... B25H 3/028 312/348.4
2009/0134074 A1 * 5/2009 Doran ..... C02F 9/005 210/85
2010/0116847 A1 * 5/2010 Foroughi ..... B67D 1/0869 222/81
2011/0180153 A1 * 7/2011 Carter ..... D06F 29/005 137/312
2015/0090859 A1 * 4/2015 Deryckere ..... A47B 91/005 248/676

(Continued)

*Primary Examiner* — James O Hansen
(74) *Attorney, Agent, or Firm* — RatnerPrestia

(57) ABSTRACT

An appliance pedestal system having: a cabinet defining an enclosure having a front face and an opening through the front face; a drawer comprising an open-topped container movably mounted to the cabinet and configured to slide between a closed position in which a drawer front at a front end of the drawer is adjacent the front face of the cabinet and an open position in which the drawer front is spaced from the front the face of the cabinet; and a trim piece configured to be selectively connected to a bottom of the drawer at a location below the drawer front, or to the front face of the cabinet at a location below the drawer front when the drawer is in the closed position. The drawer may comprise other types of closure, such as a door. A method for installing the pedestal system is also provided.

16 Claims, 4 Drawing Sheets

(56) References Cited

U.S. PATENT DOCUMENTS

2017/0336129 A1* 11/2017 Cunningham ..... F25D 19/00

* cited by examiner

APPLIANCE PEDESTAL SYSTEM

TECHNICAL FIELD

This application is directed to pedestal systems for holding appliances such as laundry washing machines and washer/dryers.

BACKGROUND

Typical laundry washing machines use water and other liquids to clean clothing and other goods. To this end, a typical laundry washing machine is connected to hot and cold water mains, and may also allow introduction of other liquids such as detergents. The laundry washing machine may be a dedicated washer, or it also may having drying functionality (i.e., a washer/dryer).

Laundry washing machines are sometimes mounted on a pedestal. A pedestal can provide a storage facility below the machine, and is useful to raise the height of the access door on the machine (which is particularly helpful for front-loading machines). Washing machines are also sometimes located on top of a drip tray that is configured to trap liquids that might drip from the machine, such as by spillage by the operator or leaks in or around the machine.

Drip trays and pedestals are also sometimes used together. However, pedestals having openable closures, such as drawers, can sometimes be incompatible with certain drip trays due to interference between the upstanding edge of the drip tray and the pedestal closure. For example, a drip tray might be too tall to allow the closure to move. This leads to user inconvenience and dissatisfaction.

This description of the background is provided to assist with an understanding of the following explanations of exemplary embodiments, and is not an admission that any or all of this background information is necessarily prior art.

SUMMARY

In a first aspect, there is provided an appliance pedestal system having a cabinet defining an enclosure having a front face and an opening through the front face, a drawer comprising an open-topped container movably mounted to the cabinet and configured to slide between a closed position in which a drawer front at a front end of the drawer is adjacent the front face of the cabinet and an open position in which the drawer front is spaced from the front the face of the cabinet, and a trim piece configured to be selectively connected to a bottom of the drawer at a location below the drawer front, or to the front face of the cabinet at a location below the drawer front when the drawer is in the closed position.

In some aspect, the trim piece may be alternately and selectively connected to a bottom of the drawer at a location below the drawer front, or to the front face of the cabinet at a location below the drawer front when the drawer is in the closed position.

In some aspects, the trim piece may be configured to be selectively connected to the drawer front.

In some aspects, the drawer front may be formed separately from and attached to the open-topped container.

In some aspects, the trim piece has a front trim boundary having a first cross-sectional shape as viewed along a vertical axis, the drawer front has a front drawer boundary having a second cross-sectional shape as viewed along the vertical axis, and the first cross-sectional shape and the second cross-sectional shape are the same and overlap as viewed along the vertical axis when the drawer is in the closed position.

In some aspects, the trim piece comprises a rear face having a first plurality of fastener locations arranged in a first pattern and a top face having a second plurality of fastener locations arranged in a second pattern, the front face of the cabinet has a third plurality of fastener locations arranged in a third pattern matching the first pattern, and the bottom of the drawer has a fourth plurality of fastener locations arranged in a fourth pattern matching the second pattern. The fastener locations may be holes.

In some aspects, the drawer is slidably mounted to the cabinet by one or more sliders.

In some aspects, the appliance pedestal system further includes a drip tray configured to extend below the cabinet. The drip tray has a generally planar surface and a perimeter wall extending upwards from the generally planar surface to surround a portion of the cabinet, and wherein the bottom of the drawer at the location below the drawer front is positioned above an upper edge of an adjacent portion of the perimeter wall. The perimeter wall may be dimensioned to surround the portion of the cabinet and the trim piece when the trim piece is attached to the front face of the cabinet.

In another exemplary aspect, there is provided an appliance pedestal system having a cabinet defining an enclosure having a front face and an opening through the front face, a door movably mounted to the cabinet and configured to move between a closed position in which the door covers the opening, and an open position in which the door does not cover the opening, and a trim piece configured to be selectively or alternately and selectively connected to a bottom of the door, or to the front face of the cabinet at a location below the door when the door is in the closed position.

In some aspects, the appliance pedestal system may further include a drip tray configured to extend below the cabinet, the drip tray having a generally planar surface and a perimeter wall extending upwards from the generally planar surface to surround a portion of the cabinet, and wherein the bottom of the door is positioned above an upper edge of an adjacent portion of the perimeter wall. The perimeter wall may be dimensioned to surround the portion of the cabinet and the trim piece when the trim piece is attached to the front face of the cabinet.

In another exemplary aspect, there is provided a method for installing an appliance pedestal system. The method includes: determining a first distance in a vertical direction between a surface upon which a cabinet is intended to be positioned and a lowermost point on a movable element mounted on the cabinet; determining a second distance in the vertical direction between the surface and a lowermost point on a trim piece when the trim piece is connected to the movable element; determining a third distance in the vertical direction between the surface and an uppermost point on an object within a movement path of the movable element; upon determining that the third distance is less the than first distance and the second distance, installing the cabinet on the surface with the trim piece connected to the movable element; and upon determining that the third distance is less than the first distance and greater than the second distance, installing the cabinet on the surface with the trim piece not connected to the movable element.

In some aspects, the method also may include, upon determining that the third distance is greater than the second distance: determining a fourth distance in a horizontal direction between a front of the cabinet and a front of the trim piece when the trim piece is connected to the cabinet at a location below the movable element; determining a fifth distance in the horizontal direction between the front of the cabinet and a nearest point on the object; upon determining that the fifth distance is greater than the fourth distance, installing the cabinet on the surface with the trim piece connected on the cabinet at the location below the movable element; and upon determining that the fifth distance is less than the fourth distance, installing the cabinet on the surface with the trim piece not connected to the cabinet.

BRIEF DESCRIPTION OF THE DRAWINGS

Embodiments of inventions will now be described, strictly by way of example, with reference to the accompanying drawings, in which.

DESCRIPTION OF EXEMPLARY EMBODIMENTS

It has been determined that improvements to appliance pedestal systems can be made to address problems associated with using an appliance pedestal on a drip tray. Disclosed herein are various non-limiting exemplary embodiments of appliance pedestal systems that provide improve compatibility between the appliance pedestal and a drip tray.

Referring to FIGS. 1-6C, a first embodiment of an appliance pedestal system 100 is shown in various views. In general terms, the pedestal system 100 includes a cabinet 102, a drawer 104, and a trim piece 106.

Figure 2:
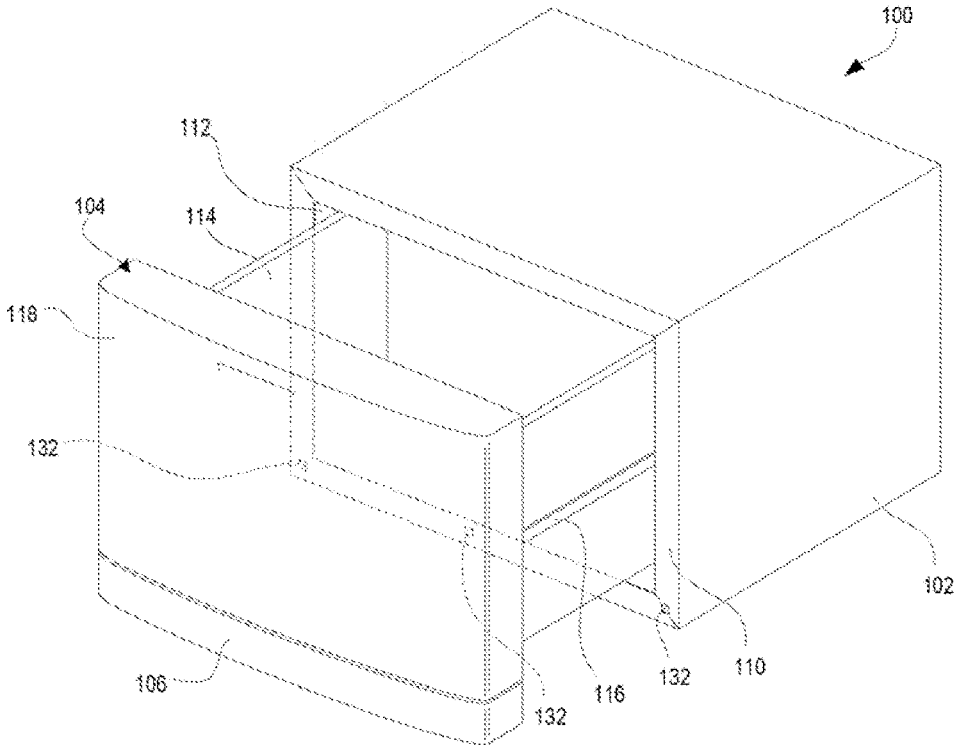
FIG. 2 is an isometric view of the appliance pedestal system of claim 1, shown with the drawer in an open position with the trim piece attached to the drawer.
Figure 3:
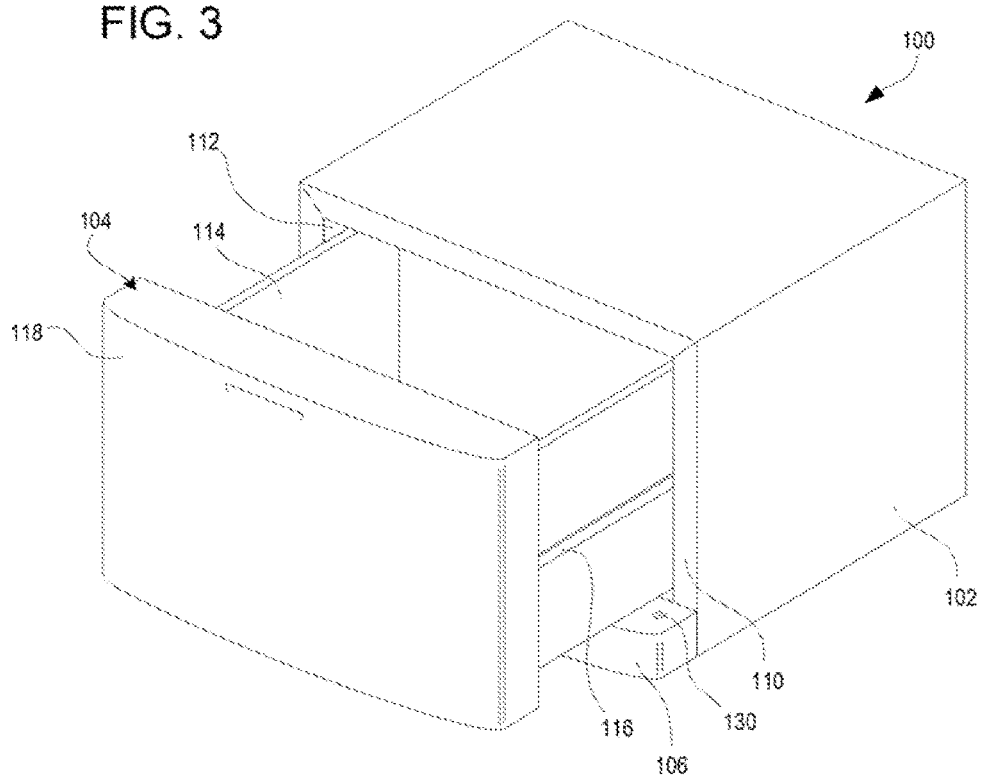
FIG. 3 is an isometric view of the appliance pedestal system of claim 1, shown with the drawer in an open position with the trim piece attached to the cabinet.

The cabinet 102 is shaped and dimensioned to provide vertical support for an appliance 108, such as a laundry washing machine. Thus, the cabinet 102 preferably is capable of reliably supporting several hundred pounds of equipment during operation of that equipment. The cabinet 102 preferably comprises a generally cubic structure having flat outer surfaces. Support, such as adjustable feet 122 (see FIGS. 6A-C), may be provided to hold the cabinet 102 on a surface, and additional connectors or supports (not shown) may be provided on the top and/or sides of the cabinet to engage with corresponding connectors or supports on the appliance 108. As shown in FIGS. 2 and 3, the cabinet 102 includes a front face 110, which defines an opening 112.

The cabinet 102 may be formed, for example, as folded and welded sheet metal, a metal space frame having a lightweight or non-structural outer skin, a structural polymer, or any other structure or combination of structures. The design and manufacture of such cabinet structures is known in the art and need not be described herein in more detail.

The drawer 104 comprises an open-topped container 114 that may be shaped and sized to hold various objects, such as laundry supplies or the like. The drawer 104 is mounted to the cabinet 102 to move within the opening 112. For example, the drawer 104 may be mounted to the cabinet 102 by drawer slides 116 or the like, such as known in the art. The drawer 104 has a drawer front 118 located at a front end 120 (see FIGS. 6A-C) of the drawer 104. The drawer front 118 may be integrally formed with the front end 120 of the drawer 104, or it may be a part that is formed separately from the open-topped container 114 or other parts of the drawer 104 and attached to form part of the front end 120.

The drawer 104 is movable between a closed position (see, e.g., FIG. 1) in which the drawer front 118 is adjacent the front face 110 of the cabinet 102, and an open position (see, e.g., FIGS. 2-3) in which the drawer front 118 is spaced from front the face of the cabinet. The drawer front 118 preferably is shaped and sized to cover the opening 112 when the drawer 104 is in the closed position, but this is not strictly necessary.

The trim piece 106 is configured to be connected, at the manufacturer's, appliance installer's or user's option, either to the drawer 104 or to the cabinet 102. When connected to the drawer 104, the trim piece 106 is located below the drawer front 118 (see, e.g., FIG. 2). In this configuration, the trim piece 106 moves along with the drawer 104 between the open and closed positions. When connected to the cabinet 102, the trim piece 106 is located on the front face 110 at a location below where the drawer front 118 sits when the drawer 104 is in the closed position (see, e.g., FIG. 3). In this configuration, the trim piece 106 remains stationary on the cabinet 102 as the drawer 104 is moved relative to the cabinet 102.

Figure 4:
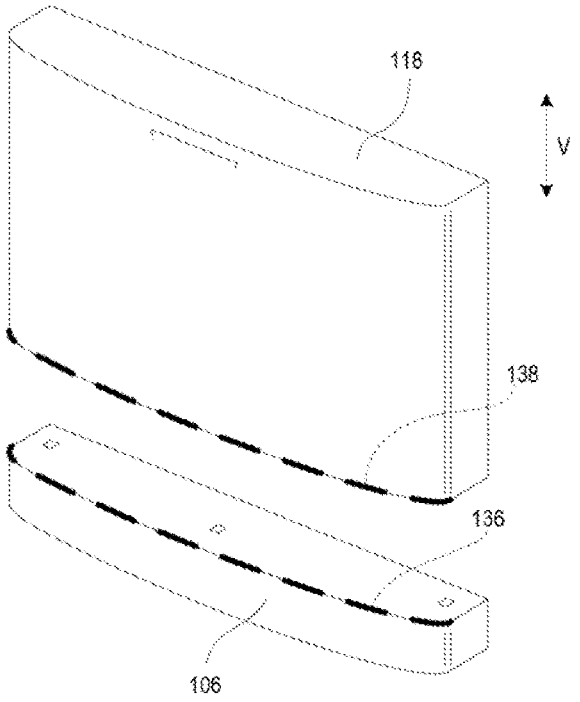
FIG. 4 is a front isometric exploded view of a drawer front and trim piece.
Figure 5:
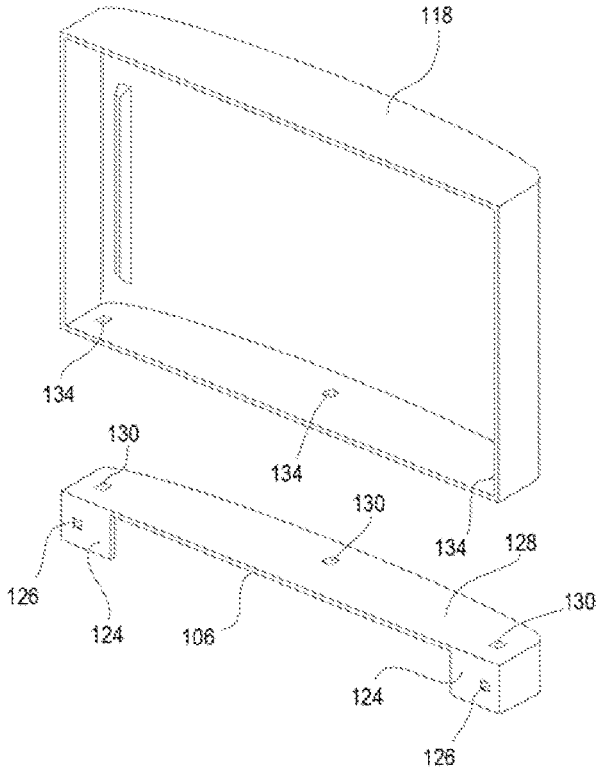
FIG. 5 is a rear isometric exploded view of the drawer front and trim piece of FIG. 4.

Any suitable connection mechanisms may be used to selectively attach the trim piece 106 to the drawer 104 or cabinet 102. For example, as shown in FIGS. 4 and 5, the trim piece 106 may include a rear face 124 having a first plurality of fastener locations 126, and a top face 128 having a plurality of second fastener locations 130. The first plurality of fastener locations 126 are arranged in a pattern that matches the pattern of a third plurality of fastener locations 132 (FIG. 2) on the front face 110 of the cabinet 102. The second plurality of fastener locations 130 are arranged in a pattern that matches the pattern of a fourth plurality of fastener locations 134 located on the drawer 104. In this example the fourth plurality of fastener locations 132 is on the drawer front 118, but in other cases some or all may be on the bottom of the container 114 or elsewhere.

During installation or use, the user can determine whether to connect the trim piece 106 to the cabinet 102 using the first and third fastener locations 126, 132, or to the drawer 104 using the second and fourth fastener locations 130, 134. Of course, the user may also opt not to install the trim piece 106 at all.

Each fastener location may comprise any suitable structure for receiving or acting as a fastener element. For example, the fastener locations may comprise round or square holes that are dimensioned to receive screws, bolts, snap-fit fasteners 140 (see, e.g., FIGS. 6A and 6B), rivets, or the like. The fastener locations also may comprise structures such as dimples, detents or markings that identify where the user should drill or punch holes to receive fasteners. The fastener locations also may simply comprise portions of the facing surfaces (e.g., surface 124 and surface 110) at which an adhesive or double-sided tape can be positioned to hold the parts together. The fastener locations also may comprise corresponding portions of integral or pre-mounted fastener elements. For example, the first fastener locations 126 may comprise snap-fit connectors (e.g., posts with enlarged ends), and the third fastener locations 130 may comprise receptacles configured to receive and hold the snap-fit connectors via resilient deformation of the receptacle (e.g., a pliable rubber cup or the like). As another, the different fastener locations may comprise hook and corresponding loop portions of a hook-and-loop fastening system. It is also considered that the fastener locations may be used for factory installation of the trim piece 106 on the drawer 104 or cabinet 102 in accordance with a customer order, or as variations of a line of appliance models. Other alternatives and variations will be apparent to persons of ordinary skill in the art in view of the present disclosure.

Figure 1:
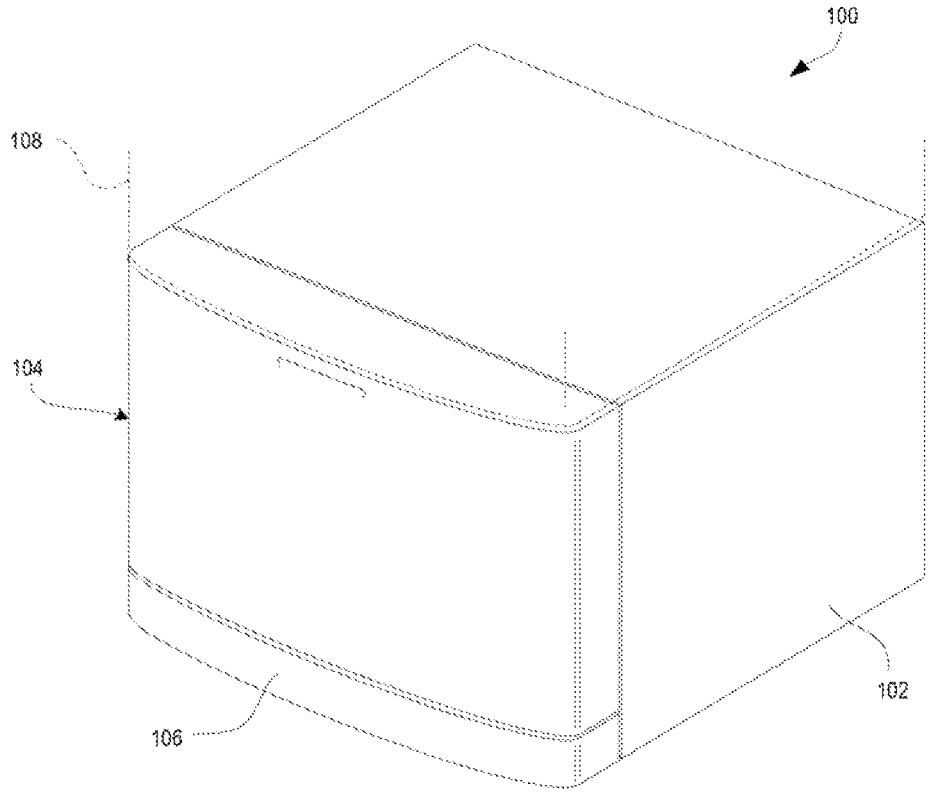
FIG. 1 is an isometric view of an exemplary appliance pedestal system, shown with the drawer in a closed position.

The trim piece 106 may be configured to match the shape of the drawer front 118. For example, the trim piece 106 might be shaped to define a front trim boundary 136 having a first cross-sectional shape as viewed along a vertical axis V, and the drawer front 118 might be shaped to define a front drawer boundary 138 having a second cross-sectional shape as viewed along the vertical axis V that is the same as the first cross-sectional shape. When the trim piece 106 is attached to the drawer 104, or when the trim piece 104 is attached to the cabinet 102 and the drawer is in the closed position, the front trim boundary 136 and the front drawer boundary 138 may overlap to provide a continuous and smooth transition, with the outer front surface of the trim piece 106 flush with and aligned with the outer front surface of the lower end of the drawer front 118, such as shown in FIG. 1.

Figure 6A:
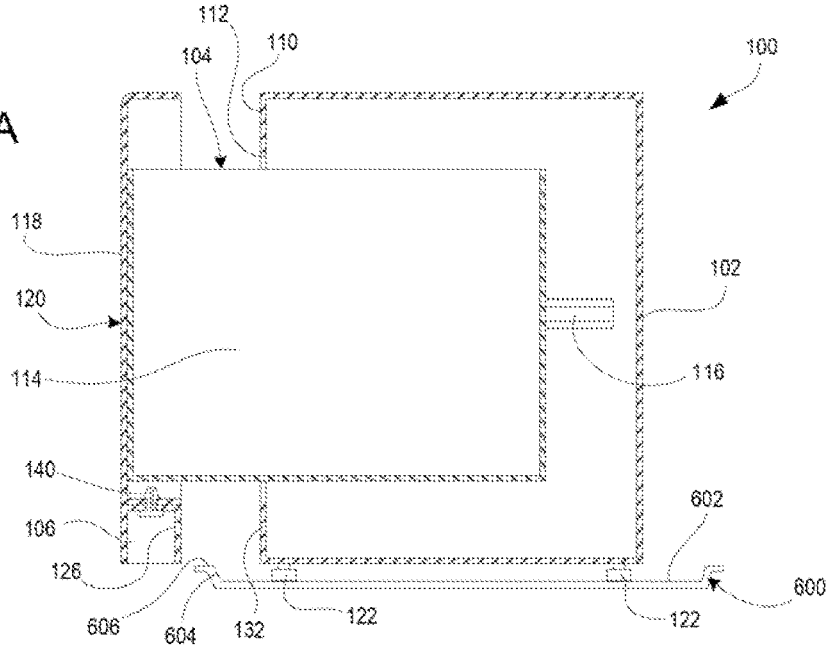
FIG. 6A is a cutaway side view of an appliance pedestal system, shown with the drawer in a partially-opened position and the trim piece attached to the drawer, and resting on a first exemplary drip tray.
Figure 6B:
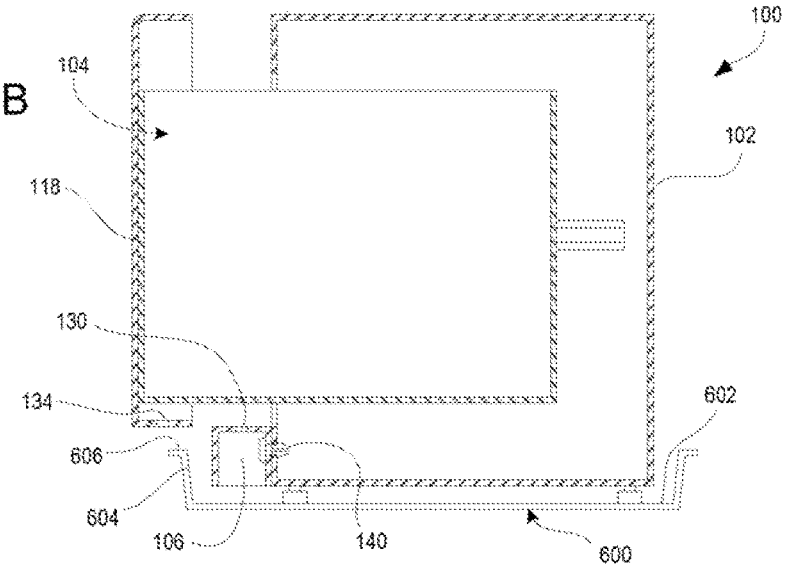
FIG. 6B is a cutaway side view of the appliance pedestal system of FIG. 6A, shown with the drawer in a partially-opened position and the trim piece attached to the cabinet, and resting on a second exemplary drip tray.
Figure 6C:
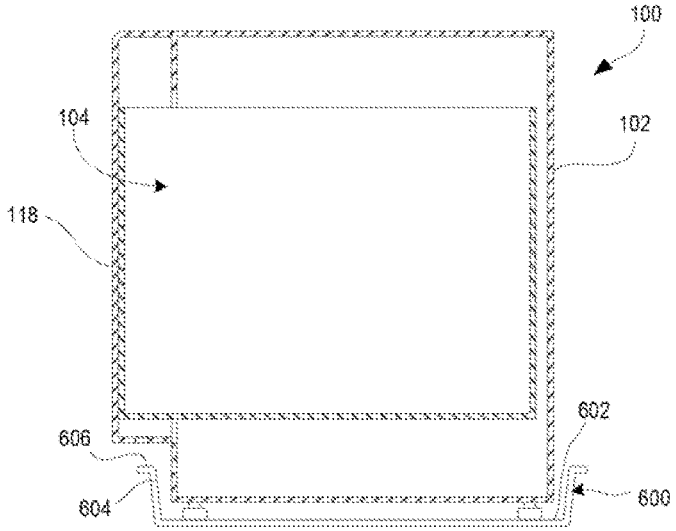
FIG. 6C is a cutaway side view of an appliance pedestal system of FIG. 6A, shown with the drawer in a closed position and the trim piece removed entirely, and resting on a third exemplary drip tray.

Referring now more specifically to FIGS. 6A-6C, the appliance pedestal system 100 also may include a drip tray 600. The drip tray 600 includes a generally planar lower surface 602 and a perimeter wall 604 that extends upwards from the lower surface 602 to surround a portion of the cabinet 102. The lower surface 602 may be entirely flat, or it may include corrugations or a textured surface or the like. The perimeter wall 604 is dimensioned to provide some degree of protection against liquids spilling out of the drip tray 600. The drip tray 600 may be provided as a portable part, such as an injection molded plastic tray or the like. Alternatively, the drip tray 600 may be formed as a building installation, such as a waterproof (e.g., concrete) bed and retaining wall that forms a shallow tray area for holding appliances, and having a drain for removing any liquid that might spill from the machines. Other alternatives and variations will be apparent to persons of ordinary skill in the art in view of the present disclosure.

The drip tray 600 in FIG. 6A is dimensioned such that the upper edge 606 of the perimeter wall 604 at a location below the drawer front 118 is positioned below the lower edge of the trim piece 106. This may be accomplished by having the entire perimeter wall 604 extend to a uniform height that lies below the trim piece 106, or by forming only a portion of the perimeter wall 604 at this height with the remainder of the perimeter wall 604 being higher (or lower). In this case, the trim piece 106 can be attached to the drawer 104 to move with the drawer 104 without contacting the drip tray 600.

In FIGS. 6B and 6C, the drip tray 600 is dimensioned such that the upper edge 606 of the perimeter wall 604 is above the lower edge of the trim piece 106, but below the bottom of the drawer 104 at the drawer front 118. This may be accomplished by having the entire perimeter wall 604 extend to a uniform height that lies below the drawer 104, or by forming only a portion of the perimeter wall 604 at this height with the remainder of the perimeter wall 604 being higher (or lower). In FIG. 6B, the trim piece 106 is attached to the cabinet 102, which is possible because the perimeter wall 604 is dimensioned to surround the lower portion of the cabinet 102 and the trim piece 106. In FIG. 6C, the perimeter wall 604 is not sufficiently large to surround both the cabinet 102 and the trim piece 106, so the trim piece 106 is omitted. In either case, the drawer 104 can move between the closed and open positions without contacting the drip tray 600.

Figure 7:
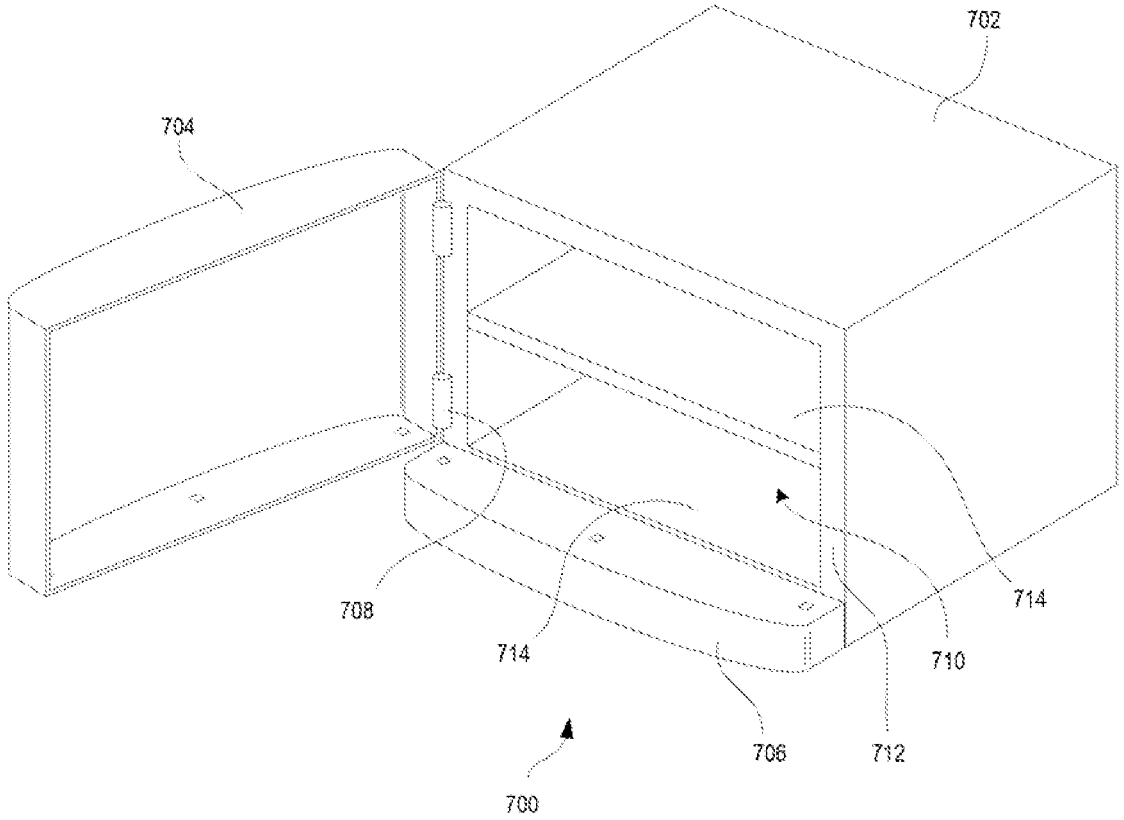
FIG. 7 is an isometric view of an alternative appliance pedestal system, shown with the door in an open position.

FIG. 7 shows another embodiment of an appliance pedestal system 700.

Here, the pedestal comprises a cabinet 702, a door 704, and a trim piece 706. The pedestal system 700 differs from the previous embodiment primarily in that the drawer has been replaced by a door 704 that is mounted to the cabinet 702 on hinges 708. The door 704 is movable between a closed position in which it covers a cabinet opening 710, and an open position (as shown) in which it does not cover the opening 710. The trim piece 706 may be alternatively and selectively connected to the bottom of the door 704, or to the front face 712 of the cabinet 702 at a location below the door 704 when the door is in the closed position. The cabinet 702 may include shelves 714, a sliding drawer, or other features for storing goods therein. As with the embodiment shown in FIGS. 6A-6C, the appliance pedestal system 700 may also include a drip tray, and the trim piece 706 may be selectively installed to account for the position of the drip tray relative to the opening path of the door 704.

Embodiments of appliance pedestal systems such as the examples described herein may provide various benefits. For example, the trim piece may be selectively positioned on either the closure or the cabinet depending on whether the trim piece would interfere with nearby objects, such as the perimeter wall of a drip tray, a carpet, a floor step, or the like. Such repositioning may also be done as a matter of aesthetic preference. Furthermore, configuring the trim piece to be installed on the cabinet or the door allows the appliance pedestal to maintain a uniform outer appearance in multiple different configurations.

Furthermore, it is not necessary for all embodiments to have a single trim piece that is alternately connectable to both the closure and the cabinet. For example, an embodiment may provide a trim piece that is only connectable to either the closure or the cabinet, or it may be provide two different trim pieces, with one being connectable to the closure, and the other being connectable to the cabinet. Thus, some embodiments may provide only selective attachment of a trim piece to the closure or the cabinet, while others provide a trim piece that can be alternately attached selectively to either the closure or the cabinet.

While the shown embodiments illustrate a drawer and a simple pivoting door, other closures may be used. For example, a door may be mounted on a slider that moves laterally with respect to the cabinet to open the cabinet enclosure. Other alternatives and variations will be apparent to persons of ordinary skill in the art in view of the present disclosure.

The decision of whether to install the trim piece to the closure or the cabinet may be made using any suitable method. For example, the appliance pedestal might be provided with written or illustrated instructions explaining how to determine whether and where to install the trim piece, or instructions may be distributed by other resources such as online videos or instructions. In one example, instructions are provided for the user to: determine a first distance in a vertical direction between a surface upon which a cabinet is intended to be positioned and a lowermost point on the movable drawer (or other closure or movable element); determine a second distance in the vertical direction between the surface and a lowermost point on the trim piece when the trim piece is connected to the drawer (or other movable element); and determine a third distance in the vertical direction between the surface and an uppermost point on the drip tray or any other object (e.g., a carpet) within a movement path of the movable element. The distances may be measured by the user, or provided as data with the instructions (e.g., a user manual indicating the predetermined distances (or range of distances) between the bottoms of the cabinet feet and the drawer and trim piece).

Upon determining the three distances, the user then determines whether the third distance is less than both the first distance and the second distance, and if so, the user can install the cabinet on the surface with the trim piece connected to the drawer without the trim piece contacting the object as the drawer is opened and closed. If, however, the third distance is less than the first distance and greater than the second distance, the user is instructed to install the cabinet on the surface with the trim piece not connected to the movable element to avoid contact between the trim piece and the object. If the third distance is greater than the first distance, then the drawer will not be openable past the object.

If it is determined that the trim piece should not be connected to the drawer to avoid contacting the objects (i.e., the third distance is greater than the second distance), the instructions may include further directions to determine whether to install the trim piece on the cabinet. For example, the instructions may direct the user to determine: a fourth distance in a horizontal direction between a front of the cabinet and a front of the trim piece when the trim piece is connected to the cabinet at a location below the drawer; and a fifth distance in the horizontal direction between the front of the cabinet and a nearest point on the object. If the fifth distance is greater than the fourth distance, there is sufficient room to install the trim piece on the cabinet, and the instructions may suggest doing so. If the fifth distance is less than the fourth distance, there is not enough room to fit the trim piece, and the instructions may include directions to install the cabinet on the surface with the trim piece not connected to the cabinet.

Of course, other methods may be used, and such methods may be applied at any desired time (e.g., during manufacture, distribution, sale or installation of the appliance pedestal system).

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. An appliance pedestal system comprising:

a cabinet defining an enclosure having a front face and an opening through the front face;

a drawer comprising an open-topped container movably mounted to the cabinet and configured to slide between a closed position in which a drawer front at a front end of the drawer is adjacent the front face of the cabinet and an open position in which the drawer front is spaced from the front the face of the cabinet; and a trim piece configured to be alternately and selectively connected to a bottom of the drawer at a location below the drawer front, and to the front face of the cabinet at a location below the drawer front when the drawer is in the closed position.

2. The appliance pedestal system of claim 1, wherein the trim piece is configured to be selectively connected to the drawer front.

3. The appliance pedestal system of claim 1, wherein the drawer front is formed separately from and attached to the open-topped container.

4. The appliance pedestal system of claim 3, wherein the trim piece is configured to be selectively connected to the drawer front.

5. The appliance pedestal system of claim 1, wherein the trim piece comprises a front trim boundary having a first cross-sectional shape as viewed along a vertical axis, the drawer front has a front drawer boundary having a second cross-sectional shape as viewed along the vertical axis, and the first cross-sectional shape and the second cross-sectional shape are the same and overlap as viewed along the vertical axis when the drawer is in the closed position.

6. The appliance pedestal system of claim 1, wherein:

the trim piece comprises a rear face having a first plurality of fastener locations arranged in a first pattern and a top face having a second plurality of fastener locations arranged in a second pattern;

the front face of the cabinet has a third plurality of fastener locations arranged in a third pattern matching the first pattern; and the bottom of the drawer has a fourth plurality of fastener locations arranged in a fourth pattern matching the second pattern.

7. The appliance pedestal system of claim 6, wherein the fastener locations comprise holes.

8. The appliance pedestal system of claim 1, wherein:

the trim piece comprises a rear face having a plurality of rear face fastener locations arranged in a rear face fastener pattern; and the front face of the cabinet has a plurality of front face fastener locations arranged in a front face fastener pattern matching the rear face fastener pattern.

9. The appliance pedestal system of claim 8, wherein:

the trim piece comprises top face having a plurality of top face fastener locations arranged in a top face fastener pattern; and the bottom of the drawer has a plurality of drawer bottom fastener locations arranged in a drawer bottom fastener pattern matching the top face fastener pattern.

10. The appliance pedestal system of claim 1, wherein:

the trim piece comprises top face having a plurality of top face fastener locations arranged in a top face fastener pattern; and the bottom of the drawer has a plurality of drawer bottom fastener locations arranged in a drawer bottom fastener pattern matching the top face fastener pattern.

11. The appliance pedestal system of claim 1, wherein the drawer is slidably mounted to the cabinet by one or more sliders.

12. The appliance pedestal system of claim 1, further comprising a drip tray configured to extend below the cabinet, the drip tray having a generally planar surface and a perimeter wall extending upwards from the generally planar surface to surround a portion of the cabinet, and wherein the bottom of the drawer at the location below the drawer front is positioned above an upper edge of an adjacent portion of the perimeter wall.

13. The appliance pedestal system of claim 12, wherein the perimeter wall is dimensioned to surround the portion of the cabinet and the trim piece when the trim piece is attached to the front face of the cabinet.

14. An appliance pedestal system comprising:

a cabinet defining an enclosure having a front face and an opening through the front face;

a door movably mounted to the cabinet and configured to move between a closed position in which the door covers the opening, and an open position in which the door does not cover the opening; and a trim piece configured to be alternately and selectively connected to a bottom of the door, and to the front face of the cabinet at a location below the door when the door is in the closed position.

15. The appliance pedestal system of claim 14, further comprising a drip tray configured to extend below the cabinet, the drip tray having a generally planar surface and a perimeter wall extending upwards from the generally planar surface to surround a portion of the cabinet, and wherein the bottom of the door is positioned above an upper edge of an adjacent portion of the perimeter wall.

16. The appliance pedestal system of claim 15, wherein the perimeter wall is dimensioned to surround the portion of the cabinet and the trim piece when the trim piece is attached to the front face of the cabinet.

* * * * *